US007624556B2

(12) United States Patent
Plooksawasdi

(10) Patent No.: US 7,624,556 B2
(45) Date of Patent: Dec. 1, 2009

(54) THREADED DEFORMED REINFORCING BAR AND METHOD FOR MAKING THE BAR

(75) Inventor: Suntisuk Plooksawasdi, Bankok (TH)

(73) Assignee: BBV Vorspanntechnik GmbH (DE)

( * ) Notice: Subject to any disclaimer, the term of this patent is extended or adjusted under 35 U.S.C. 154(b) by 563 days.

(21) Appl. No.: 10/720,473

(22) Filed: Nov. 25, 2003

(65) Prior Publication Data

US 2005/0108971 A1 May 26, 2005

(51) Int. Cl.
*E04C 3/30* (2006.01)

(52) U.S. Cl. ..... 52/851; 52/849; 52/855

(58) Field of Classification Search ..... 52/740.1, 52/740.3, 740.4, 740.5, 740.2, 740.6, 740.7, 52/740.8, 740.9, 724.2, 155, 850, 649.1, 52/295, 223.14; D25/125; 411/82, 82.3, 411/417

See application file for complete search history.

(56) References Cited

U.S. PATENT DOCUMENTS

| | | | | | |
|---|---|---|---|---|---|
| 815,619 | A | * | 3/1906 | Mueser | 52/740.5 |
| 859,643 | A | | 1/1907 | Cummings | |
| 1,339,226 | A | | 5/1920 | Schuster | |
| 2,666,348 | A | | 1/1954 | Trishman | |
| 2,932,222 | A | | 4/1960 | Connor | |
| 3,119,203 | A | | 1/1964 | Finsterwalder | |
| 3,292,337 | A | | 12/1966 | Finsterwalder | |
| 3,561,185 | A | * | 2/1971 | Finsterwalder | 52/740.5 |
| 3,717,017 | A | | 2/1973 | Vukovich | |
| 3,979,186 | A | | 9/1976 | Mizuma | |
| 4,033,502 | A | | 7/1977 | Rothchild | |
| 4,056,911 | A | * | 11/1977 | Tani | 52/740.3 |
| 4,076,163 | A | | 2/1978 | Grande | |
| 4,092,814 | A | | 6/1978 | Kern | |
| 4,114,344 | A | | 9/1978 | Heasman | |
| 4,137,686 | A | * | 2/1979 | Kern | 52/740.5 |
| 4,143,986 | A | | 3/1979 | Antosh | |
| 4,146,951 | A | | 4/1979 | Howlett | |
| 4,229,501 | A | | 10/1980 | Kern | |
| 4,241,490 | A | | 12/1980 | Edwards | |
| 4,303,354 | A | * | 12/1981 | McDowell, Jr. | 405/302.1 |
| 4,469,465 | A | | 9/1984 | Andrus | |
| 4,584,247 | A | * | 4/1986 | Mulholland | 428/592 |
| 4,619,096 | A | | 10/1986 | Lancelot, III | |
| 4,627,212 | A | | 12/1986 | Yee | |
| 4,666,326 | A | | 5/1987 | Hope | |

(Continued)

FOREIGN PATENT DOCUMENTS

| | | |
|---|---|---|
| DE | 2600175 | 7/1977 |

(Continued)

*Primary Examiner*—Richard E Chilcot, Jr.
*Assistant Examiner*—William V Gilbert
(74) *Attorney, Agent, or Firm*—Henry B. Ward, III; Moore & Van Allen

(57) ABSTRACT

The threaded deformed reinforcing bar is used in concrete construction and may be easily connected to other threaded deformed reinforcing bars by an internally threaded coupler. The threaded deformed reinforcing bar has a continuous spiral thread upon at least a portion of its length which engages the internally threaded coupler. The continuous spiral thread upon the deformed reinforcing bar is formed by eliminating portions of longitudinal ribs that are formed upon the reinforcing bar during manufacturing. This process for forming the threaded deformed reinforcing bar is less expensive than conventional processes.

12 Claims, 6 Drawing Sheets

U.S. PATENT DOCUMENTS

| | | | | | |
|---|---|---|---|---|---|
| 4,710,052 | A | | 12/1987 | Elger | |
| 4,781,006 | A | | 11/1988 | Haynes | |
| 4,811,541 | A | | 3/1989 | Finsterwalder | |
| 4,819,469 | A | | 4/1989 | Kies et al. | |
| 4,856,952 | A | * | 8/1989 | Shaw | 411/413 |
| 4,870,848 | A | | 10/1989 | Kies et al. | |
| 4,877,463 | A | | 10/1989 | Aicher et al. | |
| 4,922,681 | A | * | 5/1990 | Russwurm et al. | 52/740.5 |
| 4,953,379 | A | | 9/1990 | Richartz | |
| 5,046,878 | A | * | 9/1991 | Young | 403/13 |
| 5,067,844 | A | | 11/1991 | Bowmer et al. | |
| 5,152,118 | A | | 10/1992 | Lancelot | |
| 5,158,527 | A | | 10/1992 | Bernard | |
| 5,193,932 | A | | 3/1993 | Wu | |
| 5,230,199 | A | | 7/1993 | Yee | |
| 5,411,347 | A | * | 5/1995 | Bowmer et al. | 403/305 |
| 5,556,223 | A | | 9/1996 | Fabel | |
| 5,664,902 | A | | 9/1997 | Holdsworth | |
| 5,669,196 | A | | 9/1997 | Dahl | |
| 5,681,126 | A | | 10/1997 | Lin | |
| 5,967,691 | A | | 10/1999 | Lancelot, III | |
| 6,089,779 | A | | 7/2000 | Lancelot, III | |
| 6,880,224 | B2 | * | 4/2005 | Colarusso et al. | 29/456 |
| 2003/0012596 | A1 | * | 1/2003 | Copping | 403/313 |

FOREIGN PATENT DOCUMENTS

| | | |
|---|---|---|
| DE | 2925917 | 6/1979 |
| DE | 3210007 | 1/1984 |
| DE | 3826342 | 2/1990 |
| DE | 3834751 | 4/1990 |
| EP | 0448488 | 9/1991 |
| FR | 2558904 | 8/1985 |
| FR | 2697555 | 5/1994 |
| GB | 2255385 | 11/1992 |
| WO | 92/08019 | 5/1992 |
| WO | 99/05375 | 2/1999 |
| WO | 99/35354 | 7/1999 |

* cited by examiner

THREADED DEFORMED REINFORCING BAR AND METHOD FOR MAKING THE BAR

FIELD OF THE INVENTION

The present invention relates to a reinforcing bar for use in reinforced concrete and a method for making a steel reinforcing bar.

BACKGROUND OF THE INVENTION

Reinforcing bars for use in reinforced concrete are well known. Such rods are placed within reinforced concrete, such as pre-stressed concrete, to enhance the strength of a structure.

Frequently, such bars have ribs extending from their circumferences to improve the adhesion of the bars within the surrounding concrete. Deformed bars have one or more series of parallel transverse ribs that extend around the circumference of the bar. In addition, the bars may have longitudinal ribs, which are formed during the manufacturing process. The transverse ribs may extend perpendicularly between the longitudinal ribs. Alternatively, the transverse ribs may be set in an inclined manner so as to extend at a non-perpendicular angle from the longitudinal ribs.

Prior art, including prior art reinforcing bars, is disclosed in the following documents: U.S. Pat. No. 3,561,185 (Finsterwalder), U.S. Pat. No. 4,033,502 (Rothchild), U.S. Pat. No. 4,056,911 (Tani), U.S. Pat. No. 4,076,163 (Grande), U.S. Pat. No. 4,092,814 (Kern), U.S. Pat. No. 4,114,344 (Heasman), U.S. Pat. No. 4,143,986 (Antosh), U.S. Pat. No. 4,193,686 (Kern), U.S. Pat. No. 4,229,501 (Kern), U.S. Pat. No. 4,241,490 (Edwards), U.S. Pat. No. 4,469,464 (Andrews), U.S. Pat. No. 4,584,247 (Mulholland), U.S. Pat. No. 4,619,096 (Lancelot III), U.S. Pat. No. 4,627,212 (Yee), U.S. Pat. No. 4,666,326 (Hope), U.S. Pat. No. 4,811,541 (Finsterwalder), U.S. Pat. No. 4,922,681 (Russwurm), U.S. Pat. No. 5,046,878 (Young), U.S. Pat. No. 5,067,844 (Bowmer), U.S. Pat. No. 5,152,118 (Lancelot), U.S. Pat. No. 5,158,527 (Bernard), U.S. Pat. No. 5,411,347 (Bowmer), U.S. Pat. No. 5,468,524 (Albribo), U.S. Pat. No. 5,664,902 (Holdsworth) and U.S. Pat. No. 5,669,196 (Dahl).

Reinforcing bars are frequently connected to one another to permit the transfer of force between them. Thus short reinforcing bars can be used in larger concrete structures. One method of connecting such bars is to ensure that they are positioned so as to overlap such that there is force transfer from one bar to another through the concrete surrounding them. A further example of connecting reinforcing bars is to weld them directly together. In this instance, the distance between the bars is shorter and the bars transfer force directly through the weld.

A third method of connecting reinforcing bars end to end is to use a mechanical connecting means. Some of these mechanical connecting means, or internally threaded members, rely upon threads for attachment to the reinforcing bars. Standard threads may be cut into a portion of the circumference of the reinforcing bar after the transverse ribs are removed along that portion. Cutting threads into a reinforcing bar may be both expensive and time-consuming.

Alternatively, a coupler having internal threads may attach to the inclined transverse ribs of a reinforcing bar. In this instance, the longitudinal ribs must be absent from the reinforcing bar so that the path of the internally threaded member upon the inclined transverse ribs is not obstructed. Furthermore, the dimensions of the transverse ribs must be precise and consistent to ensure that the coupler holds the reinforcing bars together tightly to permit for the efficient transfer of force between them. Attaching the coupler to the reinforcing bars is particularly challenging when the transverse ribs do not form a continuous spiral as in U.S. Pat. No. 4,229,501 (Kern) and U.S. Pat. No. 4,584,247 (Mulholland).

Ordinary deformed reinforcing bars are manufactured in steel rolling mills by a hot rolled production process. During this process, a billet having a square cross-section, which has been warmed in a reheating furnace, is fed through sets of opposed rollers. After the billet has been shaped into a bar, it is finished by adding both the transverse ribs and longitudinal ribs. The longitudinal ribs represent excess steel formed during the rolling process due to inconsistencies in the circumference of the deformed reinforcing bar along its length. The finished bar is then cut to a pre-determined length.

Alternatively, the threaded reinforcing bar may be manufactured without longitudinal ribs. During this process, the circumference of the reinforcing bar must be constant along its length, such that no longitudinal ribs are formed. The resulting reinforcing bar will have series of transverse ribs. Such transverse ribs form an interrupted spiral upon which a coupler may engage. An interrupted spiral prevents the smooth engagement of the coupler upon the threaded reinforcing bar. To obtain a continuous spiral transverse rib, an expensive and time-consuming process other than the hot rolling process is necessary. Specifically, a manufacturer cannot rely upon longitudinal ribs to account for inconsistencies along the length of the reinforcing bar while forming the continuous spiral rib, thus necessitating a more precise and time-consuming manufacturing process. Such a threaded reinforcing bar is more expensive to produce than a deformed reinforced bar formed with longitudinal ribs because of the precise method of manufacture that is necessary.

It is thus an object of the present invention to provide an improved reinforcing bar and a method of manufacturing such a bar.

SUMMARY OF THE INVENTION

The invention thus provides a threaded deformed reinforcing bar for use in reinforced concrete. The bar has a core and at least two series of transverse ribs on the core. The transverse ribs in each series are aligned and spaced longitudinally along the bar and each series is separated transversely from the adjacent series by a longitudinally extending gap. The ribs are angled and aligned to form a pattern of threads along the bar. The bar has a longitudinally extending rib in each longitudinally extending gap and each longitudinally extending rib is interrupted adjacent at least one end of said bar, whereby said pattern of threads is unobstructed. An internally threaded member may be selectively threaded onto the pattern of threads at least one end of the bar.

The invention further provides a threaded deformed reinforcing bar for use in reinforced concrete, where the bar has a core and at least one transversely extending rib forming a pattern of threads on the bar. The bar also has at least one longitudinally extending rib intersecting the at least one transverse rib at multiple areas along the bar. The longitudinally extending rib interrupts said pattern of threads along the bar. At least a part of the at least one longitudinally extending rib is absent from a section of the bar adjacent at least one end of said bar whereby said pattern of threads in said section is unobstructed.

The invention further provides a process for producing a threaded deformed reinforcing bar comprising a first step of hot rolling a billet to form a rolled steel bar. The rolled steel bar is then passed through a pair of opposed leader rolls to shape the rolled steel bar. The resulting shaped steel bar is fed through a pair of opposed finishing rolls so as to form at least two series of transverse ribs and at least one longitudinally extending rib upon the shaped steel bar. The transverse ribs in each series are separated by troughs. Finally, portions of the longitudinally extending ribs between at least some of the troughs are eliminated from the shaped steel bar adjacent at least one end of said bar. As a result, a continuous spiral rib adjacent at least one end of said bar is formed.

The invention further provides a process for producing a threaded deformed reinforcing bar comprising a first step of hot rolling a billet to form a rolled steel bar. The rolled steel bar is then passed through a pair of opposed leader rolls to shape the rolled steel bar. The resulting shaped steel bar is fed through a pair of opposed finishing rolls so as to form a partially finished reinforcing bar having at least two series of transverse ribs and at least one longitudinally extending rib upon the shaped steel bar. The transverse ribs in each series are separated by troughs. Finally, saw tooth rotary dies are applied to the shaped steel bar to eliminate portions of the at least one longitudinally extending rib.

The invention further provides a process for producing a threaded deformed reinforcing bar comprising a first step of hot rolling a billet to form a rolled steel bar. The rolled steel bar is then passed through a pair of opposed leader rolls to shape the rolled steel bar. The resulting shaped steel bar is passed through a pair of opposed finishing rolls so as to form a bar having at least two series of transverse ribs and at least one longitudinally extending rib upon the shaped steel bar. The transverse ribs in each series are separated by troughs. Finally, smooth groove rotary dies are applied to the shaped steel bar to eliminate portions of the at least one longitudinally extending rib.

The invention further provides a process for forming a continuous spiral thread upon a shaped steel bar having at least two series of transverse ribs and at least one longitudinally extending rib abutting against said at least two series of transverse ribs, said process comprising eliminating portions of said longitudinal ribs adjacent at least one end of said bar.

BRIEF DESCRIPTION OF THE DRAWINGS

In drawings which illustrate by way of example only an embodiment of the invention.

Figure 1:
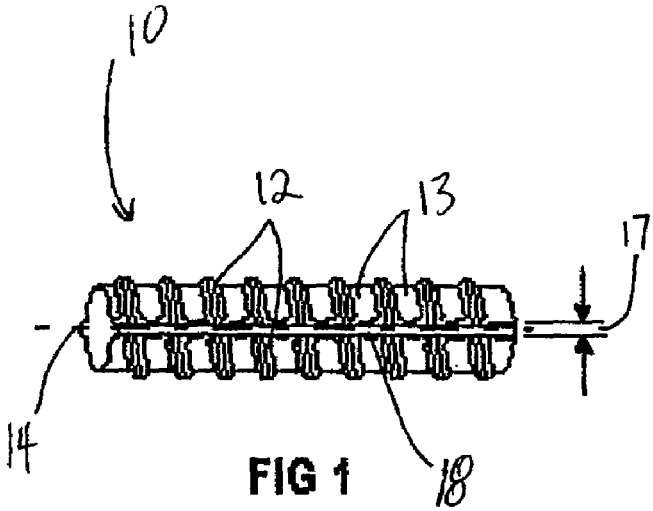
FIG. 1 is a perspective view of the threaded deformed reinforcing bar of the present invention before portions of the longitudinal rib have been removed.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 2:
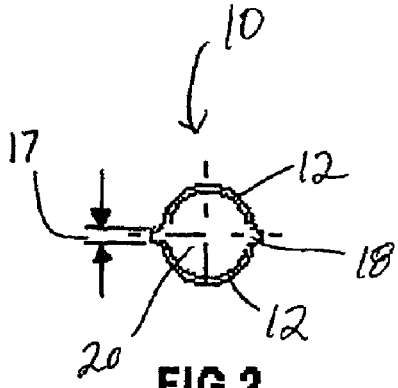
FIG. 2 is a front view of the threaded deformed reinforcing bar of the present invention before portions of the longitudinal rib have been removed.

FIGS. 1 and 2 show a partially manufactured threaded deformed reinforcing bar 10 of the present invention. The threaded deformed reinforcing bar 10 has two opposed series of inclined transverse ribs 12 aligned and positioned along a longitudinal axis 14 of the threaded deformed reinforcing bar 10 to form an interrupted thread pattern. Each individual rib within each series of inclined transverse ribs 12 is spaced longitudinally along the bar from adjacent said ribs by a trough 13. Each series of inclined transverse ribs 12 is separated from adjacent series by a longitudinally extending gap 17, in which is disposed a longitudinally extending rib 18. The inclined transverse ribs 12 are arranged substantially in parallel.

Core 20 of the threaded deformed reinforcing bar 10 has a substantially circular cross-section.

Figure 3:
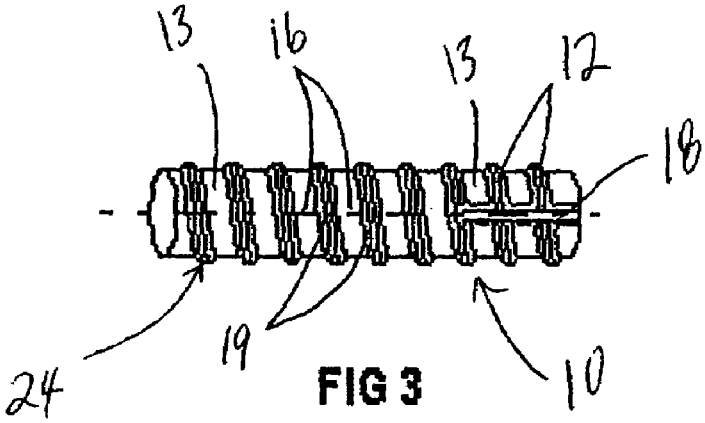
FIG. 3 is a perspective view of one embodiment of the threaded deformed reinforcing bar of the present invention.

FIG. 3 shows a section of a finished threaded deformed reinforcing bar 10, according to a first embodiment of this invention, wherein adjacent to the end of bar 10, portions of longitudinal ribs 18 in areas 16 have been removed or flattened into troughs 13. The portions 19 of longitudinal ribs 18 remain in place and, with ribs 12, form a continuous spiral thread 24.

Figure 4:
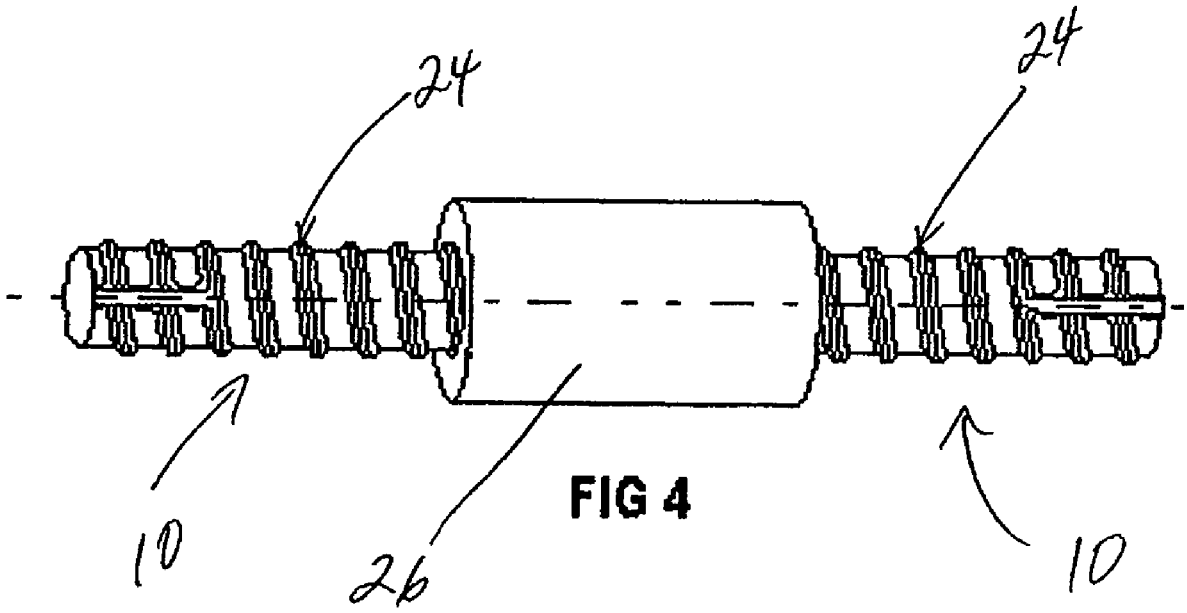
FIG. 4 is a perspective view of two threaded deformed reinforcing bars according to FIG. 3, connected by an internally threaded member.

FIG. 4 shows two finished threaded deformed reinforcing bars 10, according to the first embodiment, connected by an internally threaded member 26. Internally threaded member 26 has internal threads (not shown) with dimensions matching the continuous spiral thread on finished threaded deformed reinforcing bar 10. The internally threaded member 26 is thus in threaded engagement with each of the finished threaded deformed reinforcing bars 10.

Figure 5:
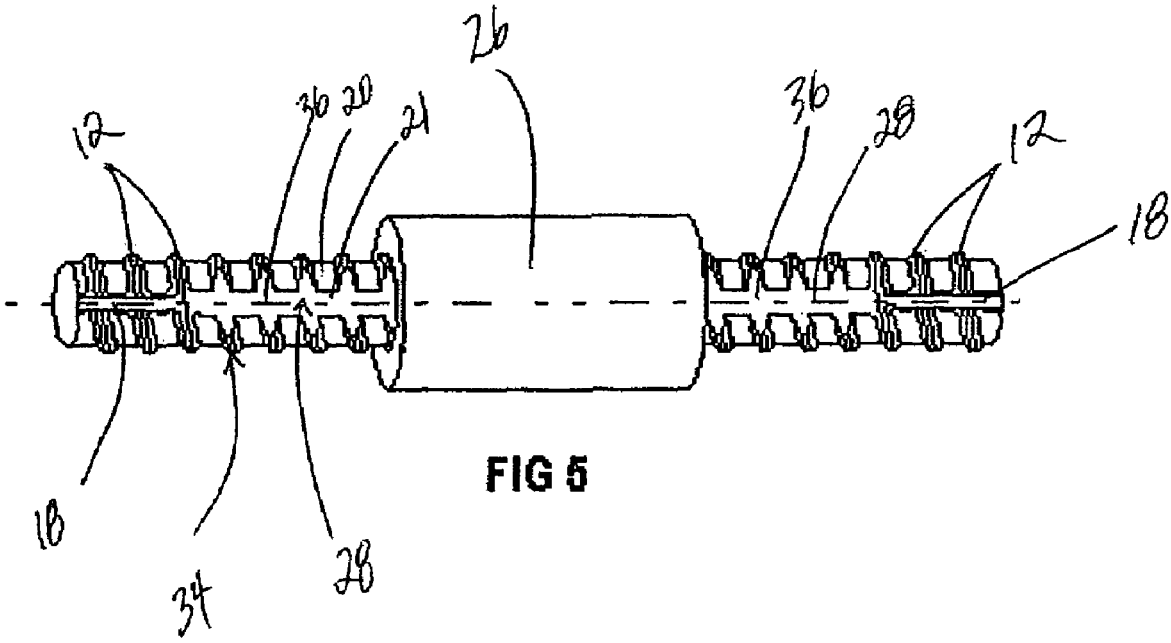
FIG. 5 is a perspective view of two threaded deformed reinforcing bars according to a further embodiment of the present invention, connected by an internally threaded member.

FIG. 5 shows a second embodiment of the invention in which each of the bars 10 of FIG. 1 have been partially sheared on two sides in a section 28 adjacent the end of the bar, forming the flattened area 36. In this embodiment, the longitudinal ribs 18 and a part of the transverse ribs 12 have been sheared off in section 28, leaving the interrupted thread pattern 34. FIG. 5 illustrates the ends of two bars according to this embodiment, joined at their ends by internally threaded member 26.

In operation, two finished threaded deformed reinforcing bars 10 are connected by the internally threaded member 26. The internally threaded member 26 is attached to a first finished threaded deformed reinforcing bar 10 by matching the thread of the finished threaded deformed reinforcing bar 10 with the internal threads at a first end of the internally threaded member 26. A second finished threaded deformed reinforcing bar 10 is then screwed into a second end of internally threaded member 26 so as to secure first finished threaded deformed reinforcing bar 10 and second finished threaded deformed reinforcing bar 10. The absence of longitudinal ribs upon a portion of the finished threaded deformed reinforcing bars 10 permit the smooth attachment of the internally threaded member 26 to the finished threaded deformed reinforcing bars 10.

Figure 6:
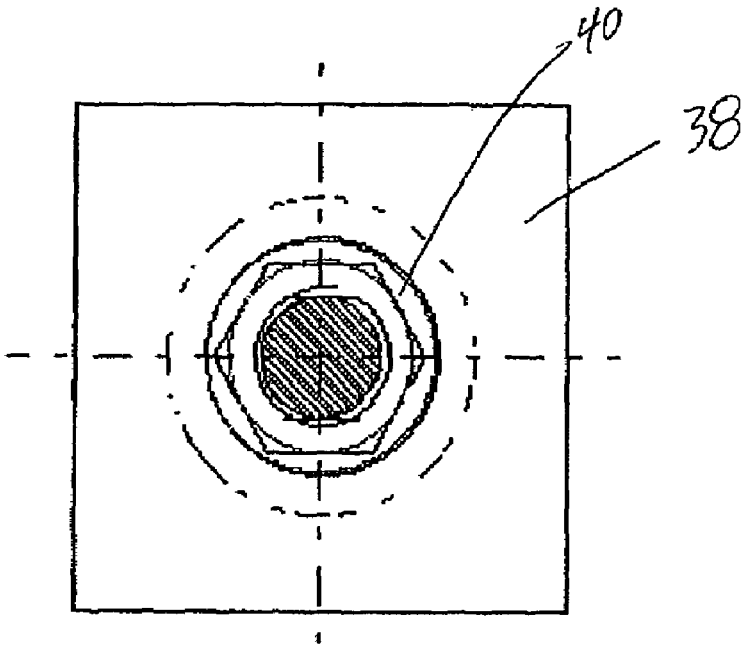
FIG. 6 is a top view of a single threaded deformed reinforcing bar of FIG. 5 used as a tension element in post-tensioning construction.
Figure 7:
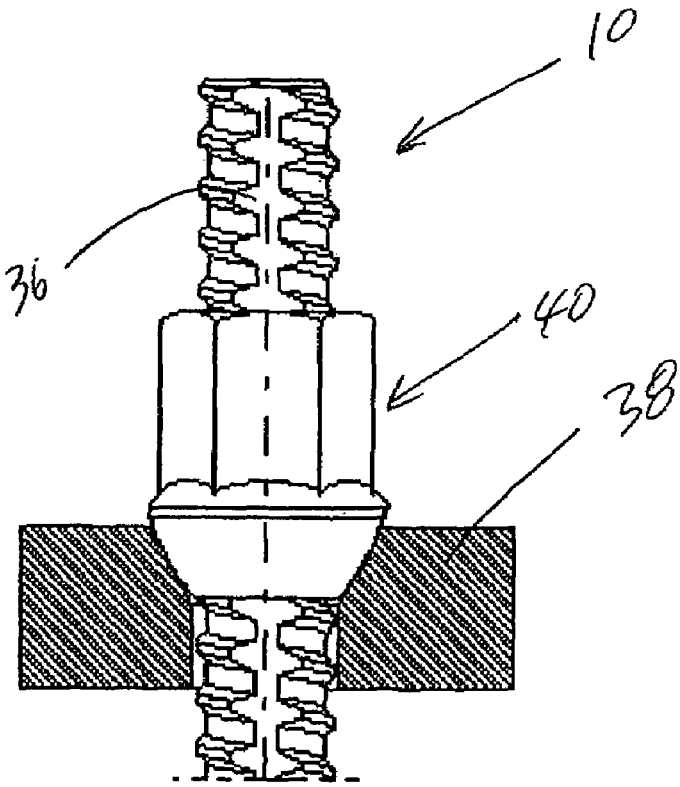
FIG. 7 is a side view of the post-tensioning construction arrangement of FIG. 6.

The bars may be manufactured so as to have high tensile strength. They are thus sometimes used as tensioning elements during post-tensioning construction, as shown in FIGS. 6 and 7. In operation, the finished threaded deformed reinforcing bar 10 is secured within a structure 38 and tensioned to a predetermined force. A nut 40 is then attached to the bar 10 to maintain tensioning force.

The threaded deformed reinforcing bar 10 may be manufactured by a hot rolling process. A billet is hot rolled so as to enhance its malleability. The resulting rolled steel bar is fed through opposed leader rolls to create a shaped steel bar. The shaped steel bar will normally have an inconsistent cross-section along its length. In a finishing step, the shaped steel bar is then fed through finishing rolls to form the series of inclined transverse ribs 12, the troughs 13, and the longitudinally extending ribs 18 upon the shaped steel bar. The finishing rolls have suitable grooving for forming inclined transverse ribs 12. During the finishing step, the cross-section of the shaped steel bar is made constant. The longitudinally extending ribs 18 are formed from excess steel from the circumference of the shaped steel bar.

To thread internally threaded member 26 onto the threaded deformed reinforcing bar 10, portions of longitudinally extending ribs 18 in areas 16 must be eliminated after longitudinally extending ribs 18 are formed. This may be achieved by a variety of methods.

Figure 8:
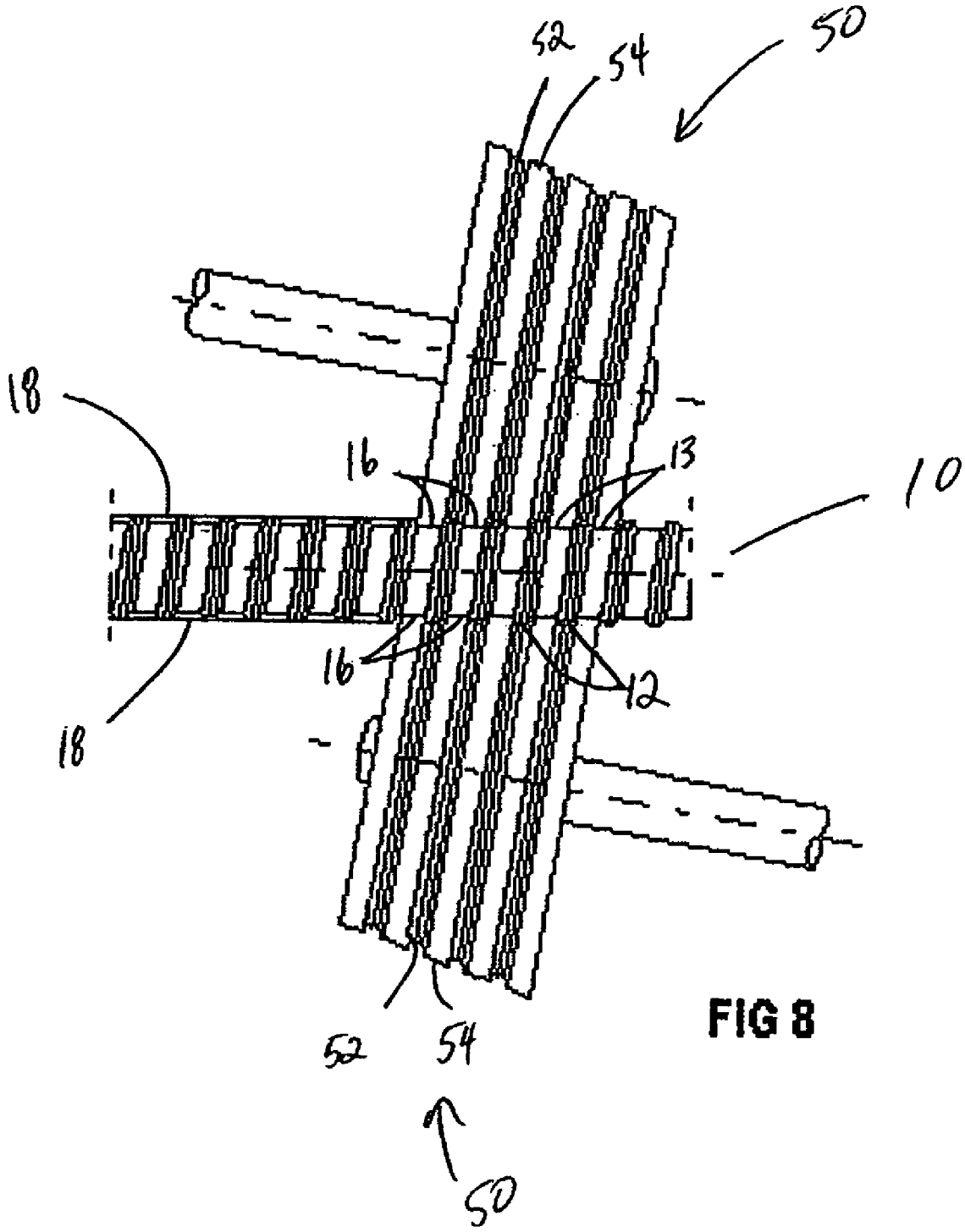
FIG. 8 is a side view of a threaded deformed reinforcing bar, according to FIG. 1, with two saw tooth rotary dies applied to it to process it into a threaded deformed reinforcing bar according to FIG. 3.

A first method for eliminating portions of longitudinally extending ribs 18 in areas 16 is to shear off those portions. This may be done using saw tooth rotary dies 50, as shown in FIG. 8, or using another suitable tool. The saw tooth rotary dies 50 consist of alternating rings to match transverse ribs 12 and troughs 13. More specifically, groove rings 52 of the saw tooth rotary die 50 match with transverse ribs 12 and ridge rings 54 of the saw tooth rotary die 50 match with troughs 13. A cross section of the saw tooth rotary die shows that the alternating groove rings 52 and ridge rings 54 form a saw tooth configuration. The saw tooth rotary dies 50 are placed such that when the saw tooth rotary dies 50 are in position contiguous to the threaded deformed reinforcing bar 10, the ridge rings 54 are in contact with the portions of longitudinally extending ribs 18 in areas 16. The saw tooth rotary dies 50 must be rotated by high power motors to achieve high velocities so as to shear the portions of longitudinally extending ribs 18 in areas 16 from the threaded deformed reinforcing bar 10. The portions of longitudinally extending ribs 18 in areas 16 may be sheared completely from the threaded deformed reinforcing bar 10 or at least to a level where internally threaded member 26 can be threaded onto threaded deformed reinforcing bar 10.

Figure 9:
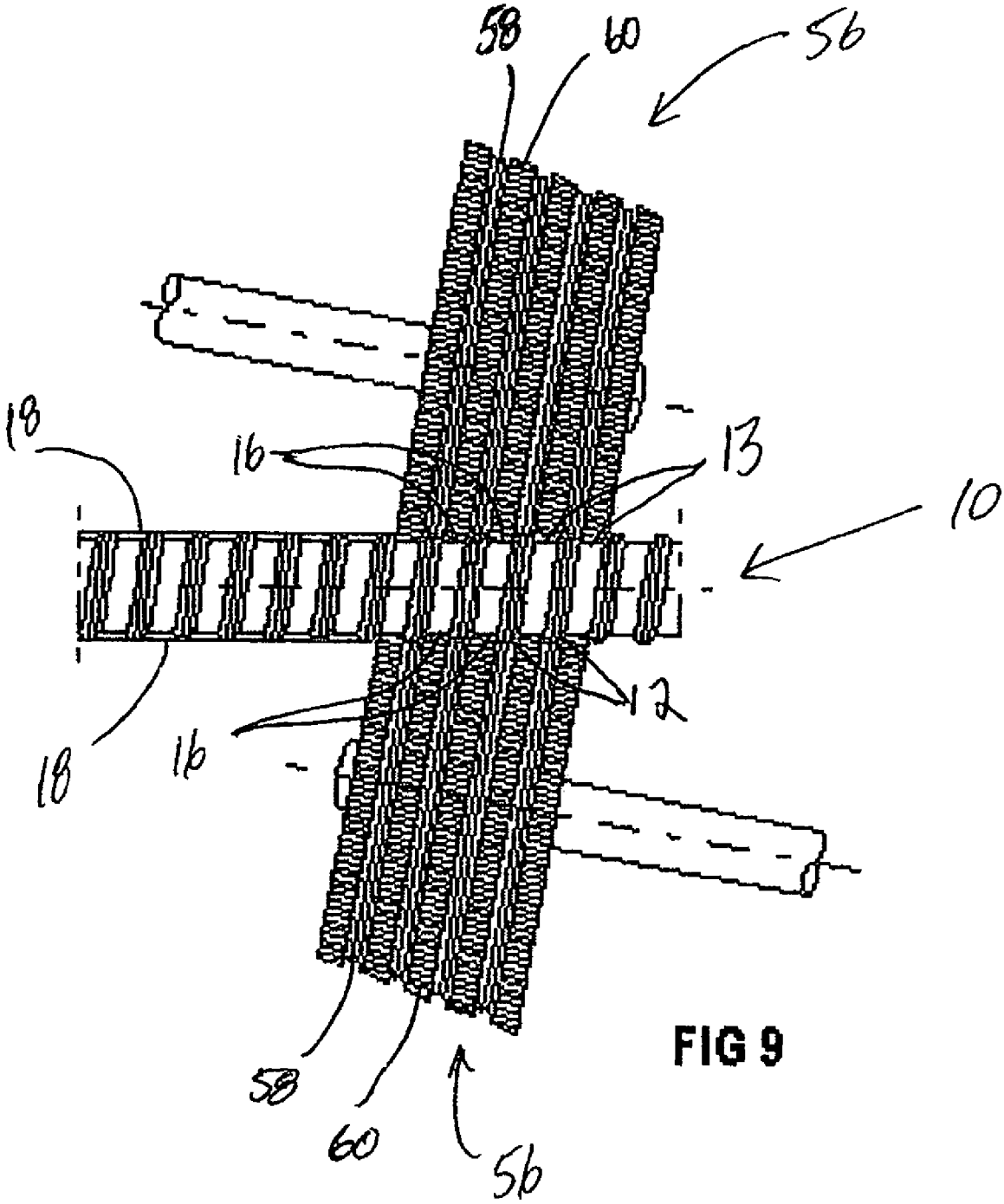
FIG. 9 is a side view of a threaded deformed reinforcing bar, according to FIG. 1, with two smooth groove rotary dies applied to in to process it into a threaded deformed reinforcing bar according to FIG. 3.

Alternatively, as shown in FIG. 9, portions of longitudinally extending ribs 18 in areas 16 of bar 10 are compressed. This may be done using smooth groove rotary dies 56 or another suitable tool to form finished threaded deformed reinforcing bar 10. Each smooth groove rotary die 56 has groove rings 58 and ridge rings 60 that resemble the groove rings and the ridge rings on the saw tooth rotary die. The groove rings 58 fit transverse ribs 12 and the ridge rings 60 fit troughs 13. The smooth groove rotary dies 56 are distinguishable from the saw tooth rotary dies 50 in that a cross-section of a smooth groove rotary die 56 demonstrates that the walls of the groove rings 58 are not slanted. The smooth groove rotary dies 56 compress portions of longitudinally extending ribs 18 in areas 16 such that those portions are flattened to the core level of bar 10 or at least to a level where internally threaded member 26 can be threaded onto bar 10. According to this method, none of bar 10, including longitudinal extending ribs 18, is removed, thus maintaining the strength of bar 10.

The above methods for eliminating portions of longitudinally extending ribs 18 in areas 16 of bar 10 can be integrated into the hot rolling process for forming threaded deformed reinforcing bar 10. Alternatively, portions of longitudinally extending ribs 18 in areas 16 can be eliminated by a cold rolling process outside of the steel mill such as at a prefabrication shop or on a construction site. This process is applied to a threaded deformed reinforcing bar 10 that has been subjected to the hot rolling process in a steel mill. A portable shearing machine or a portable compression machine may be used during the cold rolling process. The portable shearing machine functions similarly to saw tooth rotary dies 50 to remove the portions of longitudinally extending ribs 18 in areas 16. The portable compression machine functions similarly to the smooth groove rotary dies 56 to compress the portions of longitudinally extending ribs 18 in areas 16. The portions of longitudinally extending ribs 18 in areas 16 are not eliminated as quickly when portable machinery is utilized.

If no portable machinery is available outside of the mill, a further alternative for eliminating portions of longitudinally extending ribs 18 in areas 16 may be achieved by a further process. Again, this process is applied to a threaded deformed reinforcing bar 10 that has been subjected to the hot rolling process in the steel mill. The portions of longitudinally extending ribs 18 in areas 16 are sheared from the threaded deformed reinforcing bar 10. This may be done by using a tool such as a wheel grinder, thus creating sheared threaded deformed reinforcing bar 10. The wheel grinder shears portions of longitudinally extending ribs 34, portions of transversely extending ribs 30 and potentially portions of the core 20 at 21 from sheared threaded deformed reinforcing bar 10 so as to form flattened area 36 and interrupted thread pattern 34.

The methods described above for manufacturing a threaded reinforcing bar cost about the same as producing a deformed reinforcing bar with longitudinal ribs. Such costs are less than those for the more precise process of manufacturing a threaded deformed reinforcing bar without longitudinal ribs. Furthermore, these methods may be applied to threaded reinforcing bar before or after it is cut to a predetermined length. The restricting threaded deformed reinforcement bars are easily connectable by using a threaded coupler.

Thus, it is apparent that there has been provided in accordance with the invention a THREADED DEFORMED REINFORCING BAR AND METHOD FOR MAKING THE BAR that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. A threaded deformed reinforcing bar for use in reinforced concrete, said bar comprising:

a core, said core defining an outer surface and a central axis therethrough;

at least two series of transverse ribs on said core, the ribs in each said series aligned and spaced longitudinally along said bar and separated by troughs, each said series separated transversely from adjacent series by a longitudinally extending gap, and wherein said at least two series of transverse ribs are each angled and aligned with adjacent series of transverse ribs to form a pattern of threads along said bar; and a longitudinally extending rib in each said longitudinally extending gap, each said longitudinally extending rib defining an outer surface wherein the distance between the central axis of said core and the outer surface of each said longitudinally extending rib is greater than the largest distance between the central axis of said core and the outer surface of said core, each said longitudinally extending rib being absent at least one end of said bar, whereby an internally threaded member having an internal thread sized to receive said transverse ribs can be selectively threaded onto said pattern of threads, which is formed by said transverse ribs, at said at least one end.

2. The bar of claim 1 wherein said core has a substantially circular cross-section.

3. The bar of claim I wherein said transverse ribs and said longitudinal ribs are integral with each other at areas of intersection of said ribs.

4. The bar of claim 3 wherein all said ribs are integral with said core.

5. The bar of claim 1 wherein each said longitudinally extending rib terminates at a point spaced from said at least one end of said bar.

6. The bar of claim 1 wherein said longitudinal ribs are sheared off adjacent said one end of said bar.

7. The bar of claim 6 wherein parts of said transverse ribs are also sheared off adjacent said sheared off longitudinal ribs.

8. A threaded deformed reinforcing bar for use in reinforced concrete, said bar comprising:

a core;

at least one transversely extending rib forming a pattern of threads on said bar, wherein the radius of said at least one transversely extending rib and the pattern of threads is substantially the same along the length of said bar; and at least one longitudinally extending rib intersecting said at least one transverse rib at multiple areas along said bar and interrupting said pattern of threads along said bar in at least a first section of said bar;

and wherein at least a part of said at least one longitudinally extending rib is absent from a second section of said bar adjacent at least one end of said bar such that a longitudinally extending gap intersects said traverse ribs in said second section of said bar adjacent said at least one end of said bar whereby said pattern of threads, which is formed by said transverse ribs, in said second section is unobstructed, and whereby an internally threaded member having an internal thread having a substantially constant diameter sized to receive said transverse ribs can be threaded onto said pattern of threads, which is formed by said transverse ribs, in said second section.

9. The bar of claim 8 wherein said transverse rib is a continuous spiral along said bar.

10. The bar of claim 8 wherein said core has a substantially circular cross-section.

11. The bar of claim 10 wherein said at least one transverse rib includes at least two series of discontinuities extending longitudinally along said bar and wherein one said longitudinally extending rib extends along each said series of discontinuities.

12. The bar of claim 11 wherein said transverse and said longitudinally extending ribs are integral with each other and with said core.

* * * * *

UNITED STATES PATENT AND TRADEMARK OFFICE

CERTIFICATE OF CORRECTION

PATENT NO. : 7,624,556 B2
APPLICATION NO. : 10/720473
DATED : December 1, 2009
INVENTOR(S) : Suntisuk Plooksawasdi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1162 days.

Signed and Sealed this

Twenty-sixth Day of October, 2010

David J. Kappos

David J. Kappos
*Director of the United States Patent and Trademark Office*